US011008189B2

(12) United States Patent
Campbell

(10) Patent No.: US 11,008,189 B2
(45) Date of Patent: May 18, 2021

(54) PARALLEL EDGE GUIDES FOR SHEET OFFSET

(71) Applicant: XEROX CORPORATION, Norwalk, CT (US)

(72) Inventor: Richard A Campbell, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 196 days.

(21) Appl. No.: 16/414,820

(22) Filed: May 17, 2019

(65) Prior Publication Data

US 2020/0361740 A1 Nov. 19, 2020

(51) Int. Cl.

| | |
|---|---|
| ***B65H 9/10*** | (2006.01) |
| ***B65H 33/08*** | (2006.01) |
| ***B65H 29/38*** | (2006.01) |
| ***B65H 23/035*** | (2006.01) |
| ***B65H 5/36*** | (2006.01) |
| ***B65H 33/06*** | (2006.01) |

(52) U.S. Cl.

CPC ..... *B65H 9/101* (2013.01); *B65H 5/36* (2013.01); *B65H 23/035* (2013.01); *B65H 29/38* (2013.01); *B65H 33/06* (2013.01); *B65H 33/08* (2013.01); *B65H 2301/4219* (2013.01); *B65H 2301/42194* (2013.01); *B65H 2402/342* (2013.01); *B65H 2403/512* (2013.01); *B65H 2404/742* (2013.01)

(58) Field of Classification Search

CPC ..... B65H 23/035; B65H 9/101; B65H 2404/693; B65H 2404/7412; B65H 2404/741; B65H 2404/7414; B65H 2301/162; B65H 2301/4219; B65H 2402/342; B65H 2404/742; B65H 31/34; B65H 2405/11425; B65H 2405/1142; B65H 33/08; B65H 29/38; B65H 2301/42194; B41J 11/0055; G03G 15/6547; G03G 2215/0089

See application file for complete search history.

(56) References Cited

U.S. PATENT DOCUMENTS

| | | | | | |
|---|---|---|---|---|---|
| 1,130,109 | A * | 3/1915 | Rolier | B65H 1/12 | 271/160 |
| 1,421,868 | A * | 7/1922 | Volkmere | B65H 31/34 | 271/221 |
| 3,061,303 | A * | 10/1962 | Glaser | B65H 5/38 | 271/171 |
| 4,786,045 | A | 11/1988 | Sam | | |
| 5,098,081 | A * | 3/1992 | DeFigueiredo | B65H 5/38 | 271/240 |
| 8,360,420 | B2 * | 1/2013 | Tsai | B65H 31/34 | 271/171 |
| 9,206,010 | B2 * | 12/2015 | Shelhart | B65H 31/3018 | |

* cited by examiner

*Primary Examiner* — Jeremy R Severson

(57) ABSTRACT

A device for offsetting sheets as they are conveyed in a paper path toward a stacker includes a narrow channel mounted to a set of linked arms which when moved in a process direction (upstream-downstream) articulate in a cross process direction (inboard-outboard) to register the sheets at various locations for stacking or finish processing. The linked arms keep the channel parallel to the paper path at all times regardless of inboard-outboard offset.

19 Claims, 4 Drawing Sheets

PARALLEL EDGE GUIDES FOR SHEET OFFSET

BACKGROUND

Disclosed is an improved system for repositioning sheets conveyed to a sheet stacker tray or other output device for set stapling or the like.

In a typical electrostatographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the information areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Generally, printing machines employing this process or an ink jet process utilize cut sheets of paper advanced though the printing machine, one sheet at a time, for suitable processing therein. Frequently, sheets are advanced through the printing machine by transport subsystems that include mechanisms for aligning the sheet output in multiple sets. To keep each set separated, the registration assembly offsets the sets so that they will stack in the output tray offset from each other, alternately in an inboard and then in an outboard direction, the separation distance being great enough to allow the operator to separate the sets easily. It has been usual in the past for the output stacker to use a paddle wheel to urge the sheets against the moveable registration edge. For each set, the edge is moved to a new position, thereby guaranteeing that each set of sheets will be easily differentiated from the next for the benefit of the operator. One problem frequently encountered is that, as a sheet enters the offsetting area, for some skew angles, speeds and registration positions, the paddle wheels do not exert the proper force on the sheets to guarantee registration. This results in a scattering of the sheets or in a percentage of the sheets still being angled after reaching the output tray, depending on the sheet weight and type, resulting in poor offset definition for successive sets of sheets. What is required is that offset registration be accomplished while the sheets are in motion. Prior systems have been able to accomplish registration without corner damage, but only by bringing the sheet to a stop before registration. One attempt at registering sheets "on-the-fly" is shown in U.S. Pat. No. 4,786,045.

Obviously, there is still a need for offset registering of sheets for stacking "on-the-fly."

SUMMARY

Accordingly, in answer to this need, disclosed herein is a four bar linkage that is adjustable to variably position a paper edge registration guide. The linkage geometry maintains parallelism of the edge registration guide to the paper path direction. The motion of the four bar linkage can be generated either by rotating one of two links with a suitable actuator or by use of a linear force acting normal to the edge registration guide.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1A:
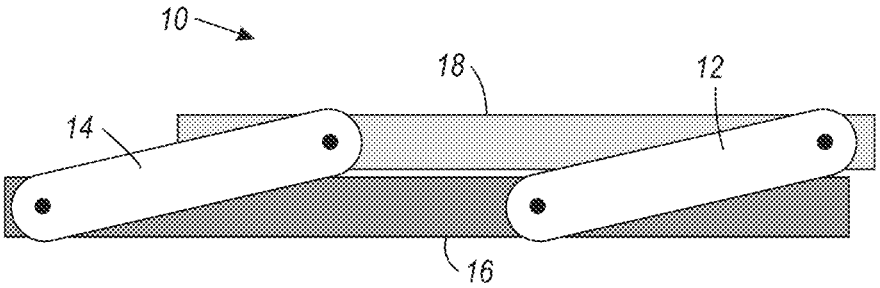
FIGS. 1A, 1B and 1C are plan views of the edge registration apparatus in accordance with the present disclosure.

For a general understanding of the features of the disclosure, reference is made to the drawings. In the drawings, like reference numerals have been used throughout to identify identical elements.

Figure 1B:
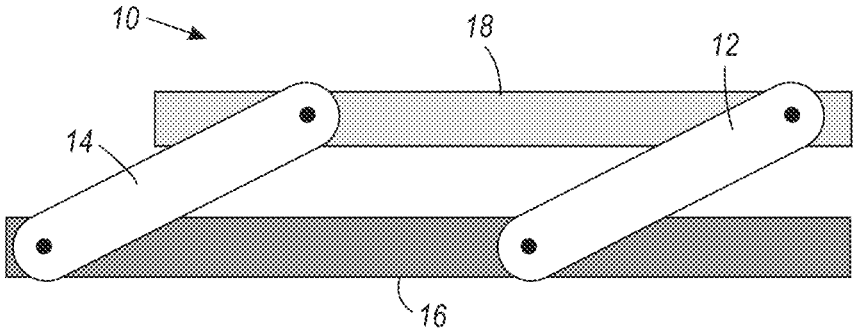
Figure 1C:
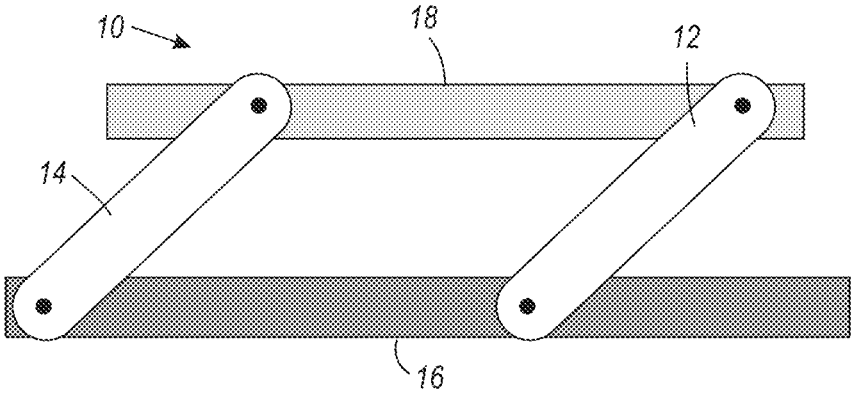

In accordance with the present disclosure, an improved edge registration apparatus 10 is disclosed in FIG. 1A that utilizes a four bar linkage with link arms including sets 12 and 14 shown rotatably connected to stationary support or fixed rail 16 and to movable registration edge 18. Edge registration apparatus 10 is shown in its resting or home position in FIG. 1A and after it has been actuated for sheet registration in FIG. 1B into a first sheet offset position and in FIG. 1C into a third sheet offset position. Links 12 and 14 are always maintained as parallel to offset sheets at any desired location.

Figure 2A:
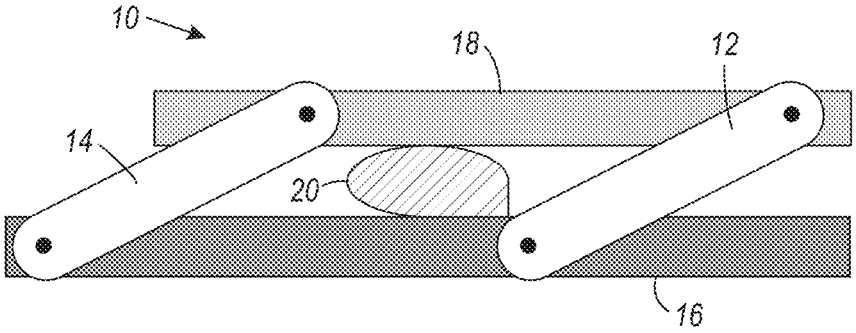
FIGS. 2A and 2B are plan views of the edge registration apparatus of FIG. 1A including a device for placing the edge registration apparatus of FIG. 1A in motion.
Figure 2B:
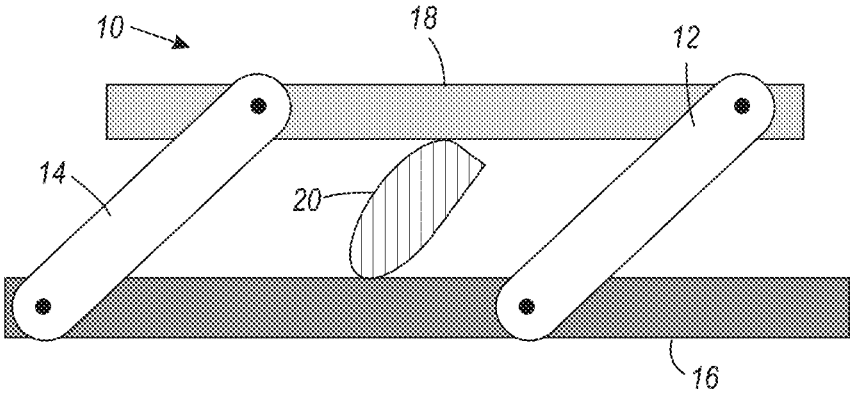

A cam like device 20 is shown positioned between movable registration edge 18 and fixed rail 16 in FIG. 2A that is used to provide spacing between fixed rail 16 and movable rail 18. The cam can be rotatably driven by conventional mechanisms, such as, a stepper motor on a link pin. In FIG. 2B, cam 20 has been rotated and movable registration edge 18 has been moved to the left away from fixed rail 16 as viewed. Cam 20 is configured to provide through rotation a wide variety of sheet shifting positions for movable registration edge 18.

Figure 3A:
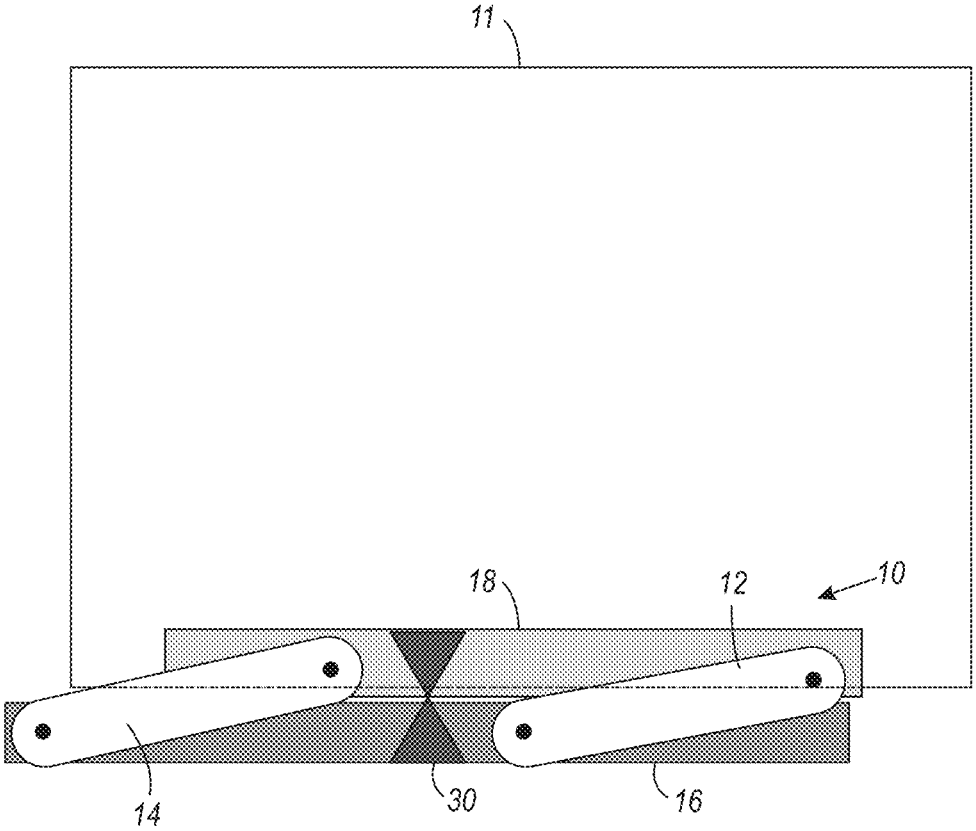
FIGS. 3A and 3B are plan views of the edge registration apparatus of FIG. 1A showing sheet offset.
Figure 3B:
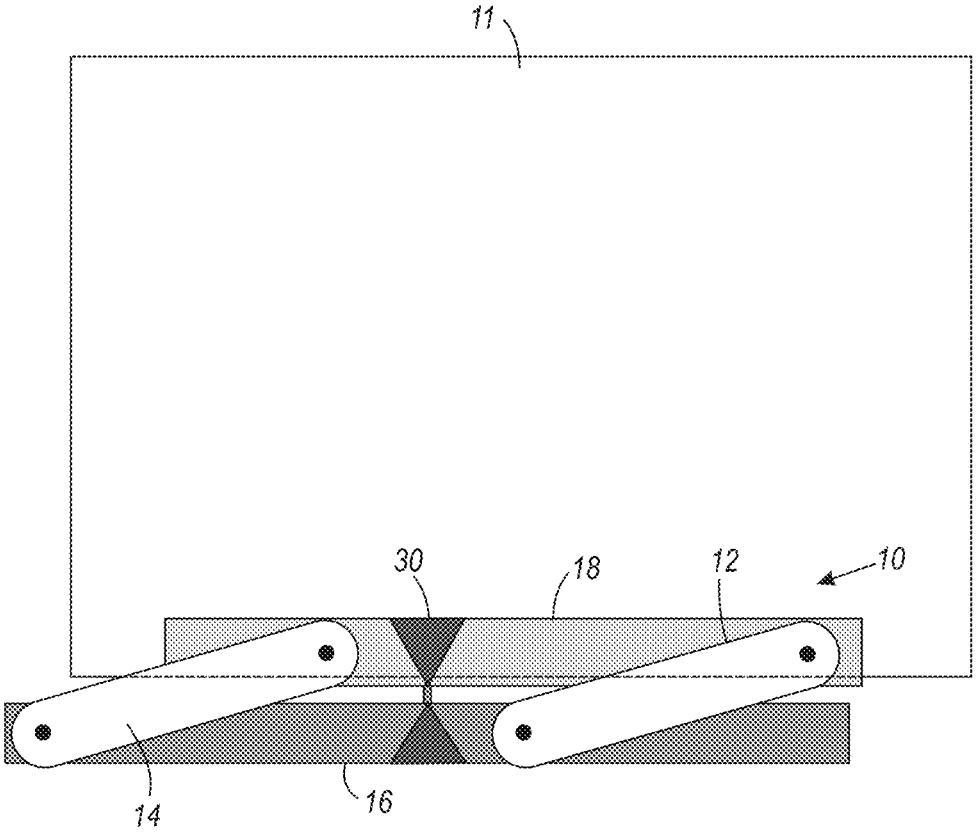
Figure 4:
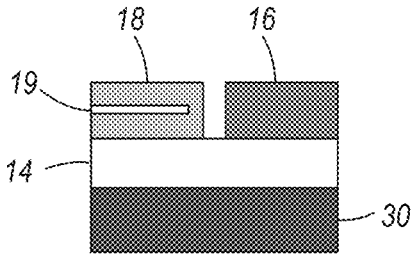
FIG. 4 is an end view of the edge registration apparatus of FIG. 3B in a sheet offset position.

Parallel link edge registration offset enablement at multiple location is shown in FIGS. 3A and 3B. In FIG. 3A, edge registration apparatus 10 is shown with a sheet 11 positioned within a channel 19 (shown in FIG. 4) of movable registration edge or rail 18 that is moved by actuators 30 that can be solenoids. In FIG. 3B, registration edge 18 has been moved into a second position spaced from fixed rail 16 by actuators 30 offsetting sheet 11. Channel 19 within movable registration edge 18 is clearly shown in FIG. 4 having been moved into the position of FIG. 3B. The movable registration guide 18 could also be moved transversely by a linear force acting normal to said movable registration guide, if desired.

In practice, sheet edge registration apparatus 10 provides quick response time, precise location, simpler manufacturing, a single entrance point height and robust alignment for registering sheets "on-the-fly." The edge registration apparatus includes a single narrow channel 19 mounted to a set of linked arms 12 and 14 which when moved in the process direction (upstream-downstream) articulate in a cross-process direction (inboard-outboard) to register sheets 11 at various locations for stacking, offsetting or finish processing. The linked arms keep the channel parallel to the paper path at all times regardless of inboard-outboard offset. The channel has a lead in angle and ramp (not shown) in order to prevent sheet stubbing when entering the channel. The movable rail 18 and the links 12 and 14 which keep the movable and fixed rails parallel are actuated by conventional devices, such as, a stepper motor mounted on a link or solenoids. Additionally, small stepper motor driven cams can be used between the rails for spacing purposes. Regardless of the method used, the rail guide position would be maintained until the next job and the offset it requires passes through. Sheet count would determine the timing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An arrangement for offsetting sheets en route to a finishing station of a printer, comprising:

a fixed rail;

a movable rail, said movable rail having a channel therein through which sheets are conveyed;

sets of linked arms connecting said fixed rail to said movable rail; and actuators configured to provide movement to said movable rail and simultaneously provide movement to said sets of linked arms to thereby move said movable rail away from said fixed rail in a cross process direction.

2. The arrangement of claim 1, wherein said sets of linked arms are always parallel to each other.

3. The arrangement of claim 2, wherein said actuators include stepper motors and link pins.

4. The arrangement of claim 2, wherein said actuators include solenoids.

5. The arrangement of claim 2, wherein said sets of linked arms are positioned on a top portion of said movable rail and said fixed rail.

6. The arrangement of claim 5, wherein each of said sets of linked arms includes a first end thereof connected to an end portion of said movable rail and an end portion of said fixed rail.

7. The arrangement of claim 6, wherein each of said sets of linked arms includes a second end thereof connected to a portion of said movable rail and a portion of said fixed rail removed from an end portion thereof.

8. The arrangement of claim 1, wherein movement of said sets of linked arms in a process direction articulate said channel in said cross process direction to register sheets for stacking.

9. The arrangement of claim 1, wherein said sets of linked arms keep said channel parallel to a paper path at all times regardless of inboard-outboard offset.

10. An edge registration system that offsets sheets being conveyed within a paper path, comprising:

a movable sheet edge registration guide, said movable sheet edge registration guide including a slit therein configured for movement of sheets therethrough as they are conveyed within said paper path;

a stationary guide positioned parallel to said sheet edge registration guide; and a four bar linkage configured to variably position said movable sheet edge registration guide transversely while simultaneously maintaining parallelism of said movable sheet edge registration guide to said stationary guide.

11. The edge registration system of claim 10, wherein motion of said movable sheet edge registration guide is accomplished with an actuator.

12. The edge registration system of claim 11, wherein said motion of said sheet edge registration guide is created by rotation of a link of said four bar linkage by said actuator.

13. The edge registration system of claim 11 wherein said motion of said sheet edge registration guide is created by a linear force acting normal to said sheet edge registration guide.

14. The edge registration system of claim 13, wherein said linear force acting normal to said sheet registration guide is provided by a cam.

15. The edge registration system of claim 11, wherein said actuator is a stepper motor.

16. A system for offsetting sheets as they are conveyed within a paper path toward a stacker, comprising:

a movable bar including a channel therein adapted for the passage of sheets conveyed within said paper path;

a stationary bar positioned parallel to said movable bar; and a four bar linkage connected to said movable bar and said stationary bar such that when said four bar linkage is moved within a process direction said movable bar is articulated in a cross process direction to register sheets in various locations for stacking purposes.

17. The system of claim 16, wherein said four bar linkage keeps said channel within said movable bar parallel to said paper path at all times regardless of inboard-outboard offset.

18. The system of claim 17, wherein said movable bar is actuated by a solenoid.

19. The system of claim 16, wherein said movable bar is actuated by a stepper motor mounted on a link pin.

* * * * *